United States Patent [19]

Uchiyama

[11] 4,232,581

[45] Nov. 11, 1980

[54] AUTOMATIC ACCOMPANIMENT APPARATUS

[75] Inventor: Yasuji Uchiyama, Hamakita, Japan

[73] Assignee: Nippon Gakki Seizo Kabushiki Kaisha, Hamamatsu, Japan

[21] Appl. No.: 895,697

[22] Filed: Apr. 12, 1978

Related U.S. Application Data

[63] Continuation of Ser. No. 659,070, Feb. 18, 1976, abandoned.

[30] Foreign Application Priority Data

| | | | |
|---|---|---|---|
| Feb. 21, 1975 | [JP] | Japan | 50-21668 |
| Feb. 28, 1975 | [JP] | Japan | 50-24524 |
| Feb. 28, 1975 | [JP] | Japan | 50-24525 |
| Feb. 28, 1975 | [JP] | Japan | 50-24526 |

[51] Int. Cl.[3] ..... G10H 1/38; G10H 1/42

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,624,263 | 11/1971 | Uchiyama | 84/1.03 |
| 3,708,604 | 1/1973 | Hebeisen et al. | 84/1.03 |
| 3,711,618 | 1/1973 | Freeman | 84/1.03 |
| 3,712,950 | 1/1973 | Freeman | 84/1.03 |
| 3,715,442 | 2/1973 | Freeman | 84/1.01 |
| 3,789,718 | 2/1974 | Bunger | 84/1.01 |
| 3,795,755 | 3/1974 | Uchiyama | 84/1.03 |
| 3,825,667 | 7/1974 | Schrecongost | 84/1.01 |
| 3,889,568 | 6/1975 | Amaya | 84/1.01 |
| 3,918,341 | 11/1975 | Bunger | 84/1.01 |
| 3,929,051 | 12/1975 | Moore | 84/1.17 |
| 3,954,038 | 5/1976 | Adams | 84/1.01 |
| 4,019,417 | 4/1977 | Carlson | 84/1.01 |

*Primary Examiner*—Stanley J. Witkowski
*Attorney, Agent, or Firm*—Ladas & Parry

[57] ABSTRACT

An automatic accompaniment apparatus capable of automatically producing a bass tone by developing notes constituting a chord in the form of a broken chord in a predetermined order when keys constituting such chord are depressed. When a plurality of keys are depressed, there often exist a plurality of different chords constituted of notes corresponding to the depressed keys. The automatic accompaniment apparatus according to the invention is adapted to detect a single chord name among these plural chords in a certain predetermined order of preference and use the fundamental note and other notes constituting the detected chord as the bass accompaniment tone. The apparatus is capable of selectively restricting generation of notes other than the fundamental note which would normally be generated in the bass accompaniment using a predetermined note as the fundamental note, thereby providing bass variation effects to the generated bass tone.

The apparatus is also capable of performing a chord while producing a bass tone in the form of a broken chord of a selected chord by using a note corresponding to a single depressed key as the fundamental note and designating suitable notes as the notes other than the fundamental note constituting the chord.

Another example of the apparatus is disclosed in which a tone range within which the bass tone can be produced consists of plural octaves and the tone range can be adjusted in accordance with a kind of rhythm or chord.

8 Claims, 12 Drawing Figures

AUTOMATIC ACCOMPANIMENT APPARATUS

This is a continuation, of application Ser. No. 659,070 filed Feb. 18, 1976, and now abandoned.

This invention relates to an automatic accompaniment apparatus capable of performing bass accompaniment corresponding to a selected chord.

There is a prior art automatic accompaniment apparatus capable of automatically conducting bass accompaniment corresponding to a selected chord while performing the chord by depressing plural keys on a keyboard. In this prior art apparatus, the lowest note and the highest note among the notes of the depressed keys are detected and these two notes are used for sounding bass tones of the bass accompaniment. The prior art apparatus, however, is defective in that no subtle variation can be afforded to the progress of the bass accompaniment and, accordingly, the bass accompaniment tends to give a monotonous impression to the audience.

It is, therefore, an object of the present invention to provide an improved automatic accompaniment apparatus which has eliminated the above described disadvantage of the prior art apparatus. According to the present invention, various notes which constitute a chord are sufficiently developed in the form of a broken chord and desirable musical effects are thereby produced.

It is another object of the invention to provide an automatic accompaniment apparatus capable of selecting a single note among notes of depressed keys in accordance with a predetermined order of preference when a chord formed by the notes of the depressed keys is undetectable and performing bass accompaniment corresponding to the selected single note. According to the invention, the base accompaniment can be performed in harmony with the progress of the chord (or melody) and a musically natural base accompaniment can be achieved.

It is another object of the invention to provide an automatic accompaniment apparatus which can be made remarkably compact by employing an integrated circuit.

It is still another object of the invention to provide an automatic accompaniment apparatus in which a mode of variation of degree of a bass tone proper to a rhythm or a kind of chord remains unchanged even in a case where a different chord is selected.

These and other objects and features of the invention will become apparent from the description made hereinbelow in conjunction with the accompanying drawings in which.

Figure 1:
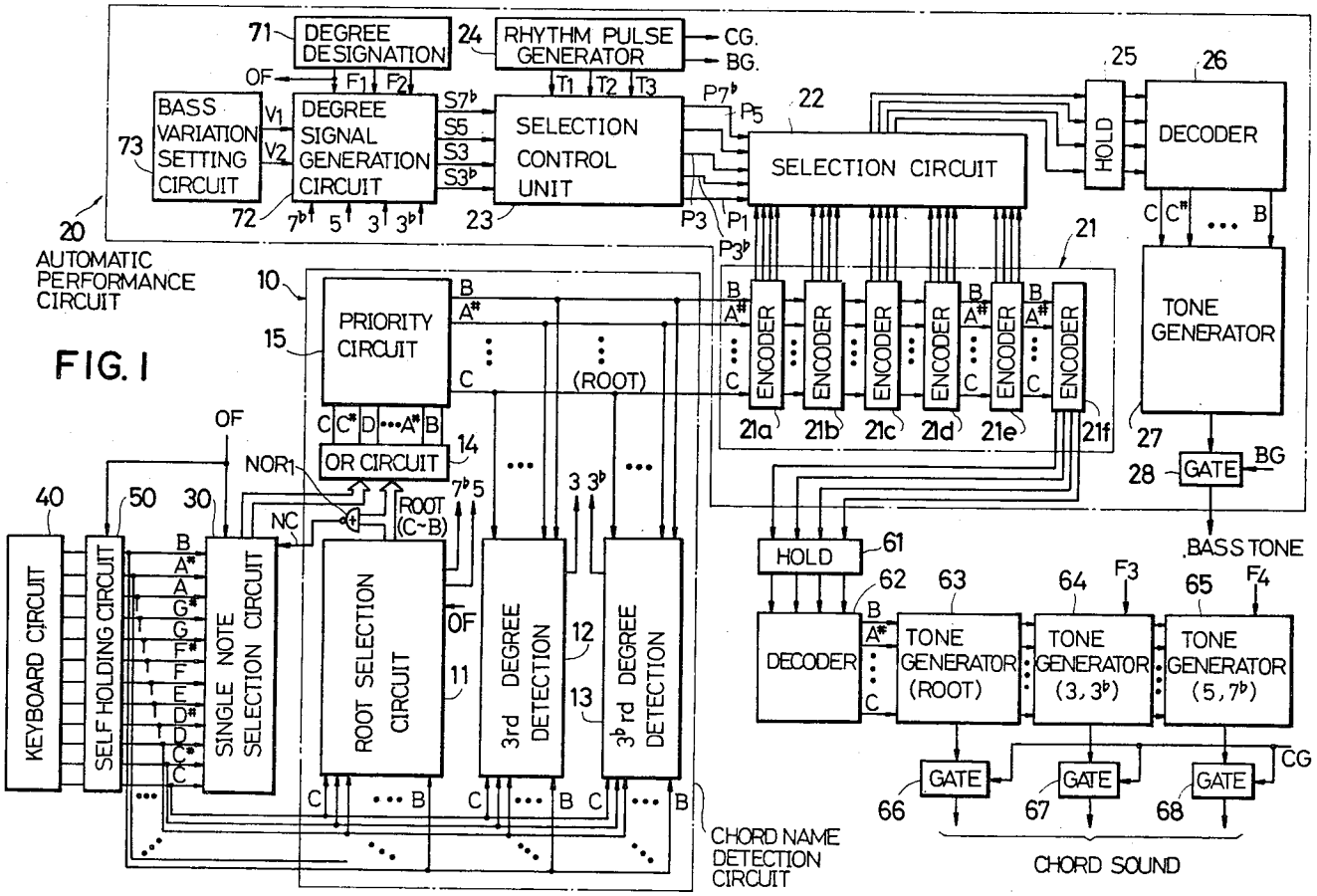
FIG. 1 is a block diagram showing an entire construction of embodiment of the automatic accompaniment apparatus according to the invention.
Figure 11:
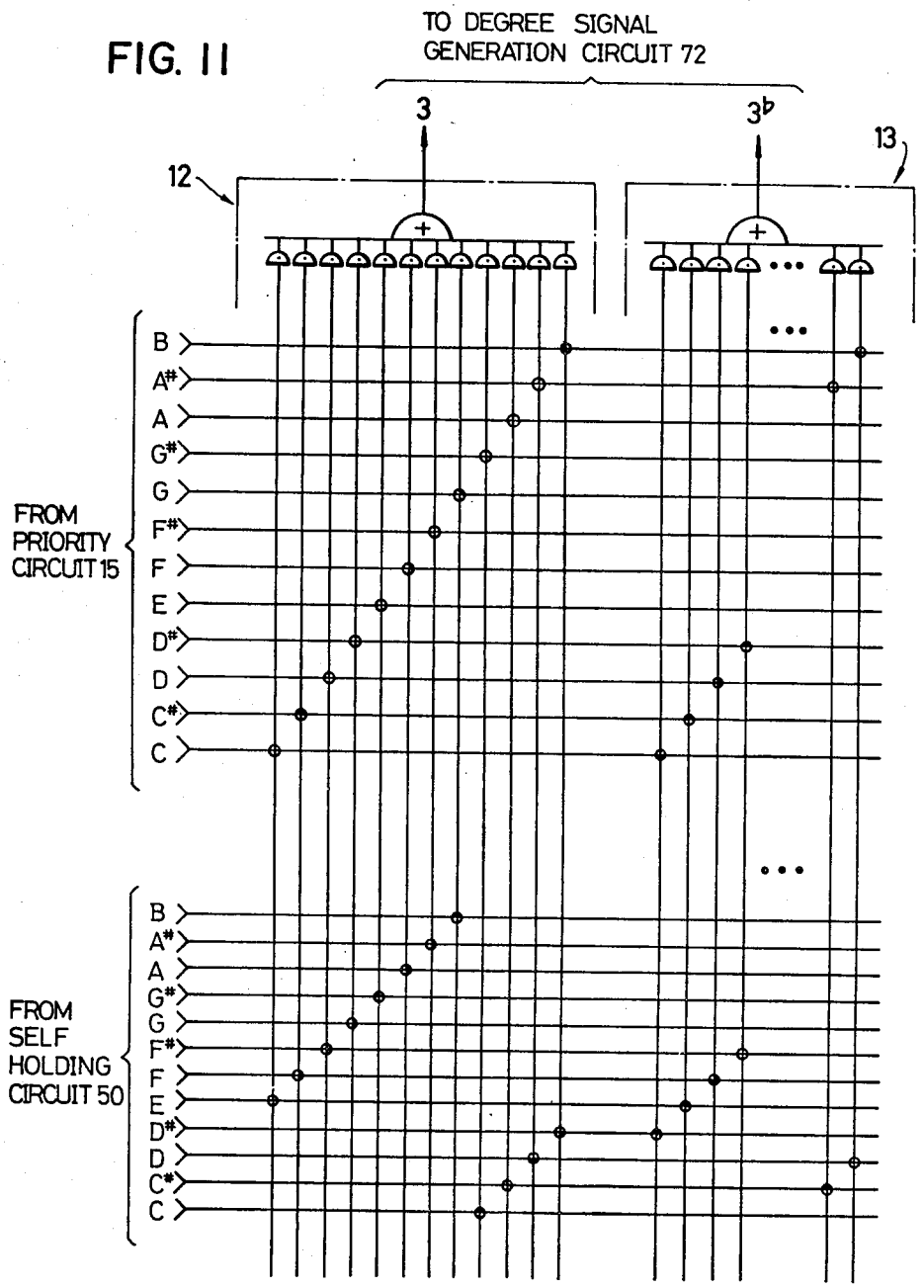
Figure 12:
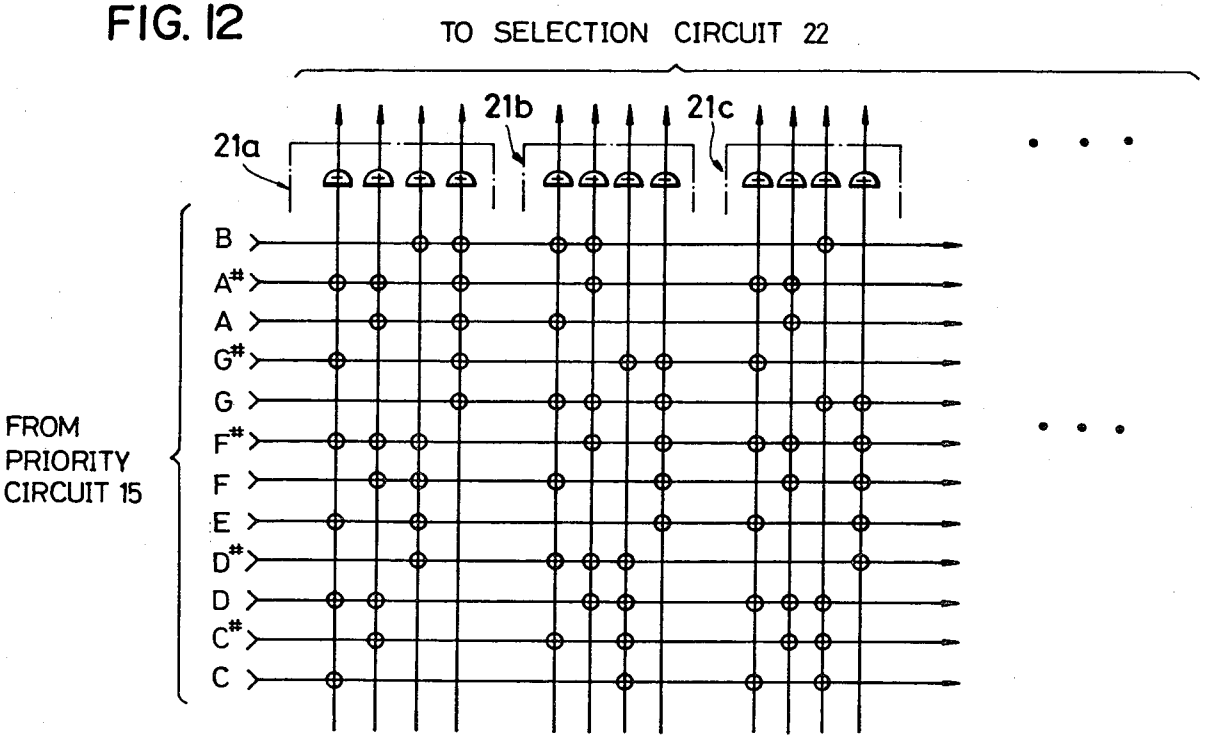

FIG. 11 is a circuit diagram showing specific examples of a major third degree detection circuit 12 and a minor third degree detection circuit 13 of FIG. 1, and FIG. 12 is a circuit diagram showing a specific example of an encoder 21 of FIG. 1.

According to the embodiment shown in FIG. 1, the performer can select either of a first automatic accompaniment system (hereinafter referred to as a "plural keys depression system") according to which the performer can conduct chord performance by depressing desired plural keys on the keyboard with a bass accompaniment automatically performed in correspondence to the chord and a second automatic accompaniment system (hereinafter referred to as a "single key depression system") according to which the performer can conduct chord performance by depressing a single key corresponding to a root (fundamental note) of the chord with a bass accompaniment automatically performed in correspondence to the chord. A keyboard circuit 40 produces signals in response to depression of keys on the keyboard. Key switch output lines for keys of the same note (i.e. C through B) are commonly connected regardless of octaves. Twelve output lines of the keyboard circuit 40 which correspond to the respective notes of a twelve note scale are connected to a self-holding circuit 50. In a case where an automatic accompaniment is performed by the plural keys depression system (which is a normal case), the self-holding circuit 50 is not actuated. In this case, the outputs of the keyboard circuit 40 pass through the self-holding circuit 50 and are applied in parallel to a chord name detection circuit 10 and a single note selection circuit 30. The self-holding circuit 50 is actuated only when a single key depression system order signal OF is applied thereto for self-holding a depressed key note signal supplied from the keyboard circuit 40. This self-holding is released when a different key is depressed.

The chord name detection circuit 10 is provided for detecting the name of the chord formed by notes corresponding to the depressed plural keys. The present embodiment is so constructed that it can detect three kinds of chords, i.e. a major triad (hereinafter referred to as "major"), a minor triad (hereinafter referred to as "minor") and a chord having a note of minor seventh degree (hereinafter referred to as "seventh") which play an important role in construction of musical pieces. Since a chord among these three kinds of chords can be determined by three elements of (1) root(i.e. fundamental note) (2) whether it contains a note of minor seventh degree and (3) whether it is "major" or "minor" (i.e. whether it contains a note of major third degree or a note of minor third degree), the chord name detection circuit 10 is so constructed that it can discriminate whether the chord being played is one of perfect fifth degree or one of minor seventh degree and thereby select the root of the chord as well as it can detect whether the chord contains a note of major third degree or a note of minor third degree. It will be appreciated from the above description that the chord name detection circuit 10 cannot detect chords other than specific kinds, e.g. "major", "minor" and "seventh". If a detectable chord (i.e. "major", "minor" or "seventh") is not detected by the chord name detection circuit 10, a no-chord-detection signal NC is applied through a NOR circuit $NOR_1$ to the single note selection circuit 30.

The single note selection circuit 30 selects, upon receipt of the no-chord-detection signal NC, a single note from among a plurality of notes corresponding to the depressed keys in accordance with the output of the keyboard circuit 40. The chord being formed by the notes of the depressed keys at the time of generation of the no-chord-detection signal is a special chord other than the three kinds of chords (or a single key has been depressed) and a single note among the plurality of notes constituting this special chord is selected by the single note selection circuit 30. Accordingly, the note selected by the single note selection circuit 30 is closely related with the progress of a chord or melody of a musical piece.

An automatic performance circuit 20 carries out base accompaniment in accordance with a detected chord name (consisting of signals representing root and either of minor third degree, major third degree, minor seventh degree and perfect fifth degree). If no chord name is detected, the note selected by the single note selection circuit 30 is deemed to be a root and the base accompaniment is carried out on the basis of this "quasi-root". The detected chord thereafter is developed in accordance with a predetermined pattern with respect to each of the root and the other notes constituting the chord so that the bass accompaniment is conducted with a desired rhythm.

An example of the chord name detection circuit 10 is shown by block 10 in FIG. 1. A minor seventh degree and perfect fifth degree discrimination and root selection circuit 11 discriminates whether the detected chord is a chord of a minor seventh degree or a normal chord of perfect fifth degree and thereupon produces a minor seventh degree detection signal $7^b$ or a perfect fifth degree detection signal 5. The circuit 11 further produces a root selection signal on one of output lines C-B corresponding to the root of the detected chord. Taking a chord C major and a chord C seventh for example, it will be noted that the root selection signal is produced on the same output line for the note C in either case whereas the degree detection signals $7^b$ and 5 are produced on different output lines. The circuit 11 comprises a logical circuit adapated for carrying out a logical formula for detecting and discriminating whether the detected chord including one of notes C-B of the twelve note scale as the root is of a minor seventh degree or a perfect fifth degree. The circuit 11 receives as its input a depressed key note signal from the keyboard circuit 40 upon depression of the key and provides a root selection signal on an output line corresponding to the root of a chord corresponding to a logical formula which this input has satisfied. Simultaneously, the circuit 11 produces the degree detection signal $7^b$ if the satisfied logical formula is one for a chord of minor seventh degree, or the degree detection signal 5 if the satisfied logical formula is one for a chord of perfect fifth degree.

The logical formula for detecting the chord of perfect fifth degree is $$K_1 \cdot \overline{K_2} \cdot \overline{K_4} \cdot K_5 \cdot \overline{K_6} \qquad (1)$$

whereas the logical formula for detecting the chord of minor seventh degree is $$K_1 \cdot \overline{K_2} \cdot \overline{K_4} \cdot \overline{K_6} \cdot K_{7b} \qquad (2).$$

These logical formulas are carried out by provision of AND circuits. In the above formulas, $K_1$ represents depressed key note signal input corresponding to the root, $K_2$ one corresponding to a note of major second degree, $K_4$ one corresponding to a note of perfect fourth degree, $K_5$ one corresponding to a note of perfect fifth degree, $K_6$ one corresponding to a note of major sixth degree and $K_{7b}$ one corresponding to a note of minor seventh degree respectively. In these logical formulas, notes of the respective degrees $K_2$–$K_{7b}$ are automatically determined if the note of the root $K_1$ is given. Bars used in $\overline{K_2}$, $\overline{K_4}$ and $\overline{K_6}$ signify that the keys of these degrees are not being depressed.

AND circuits for carrying out the logical formulas (1) and (2) are provided for each of twelve notes C-B, using each note as its root.

Figure 2:
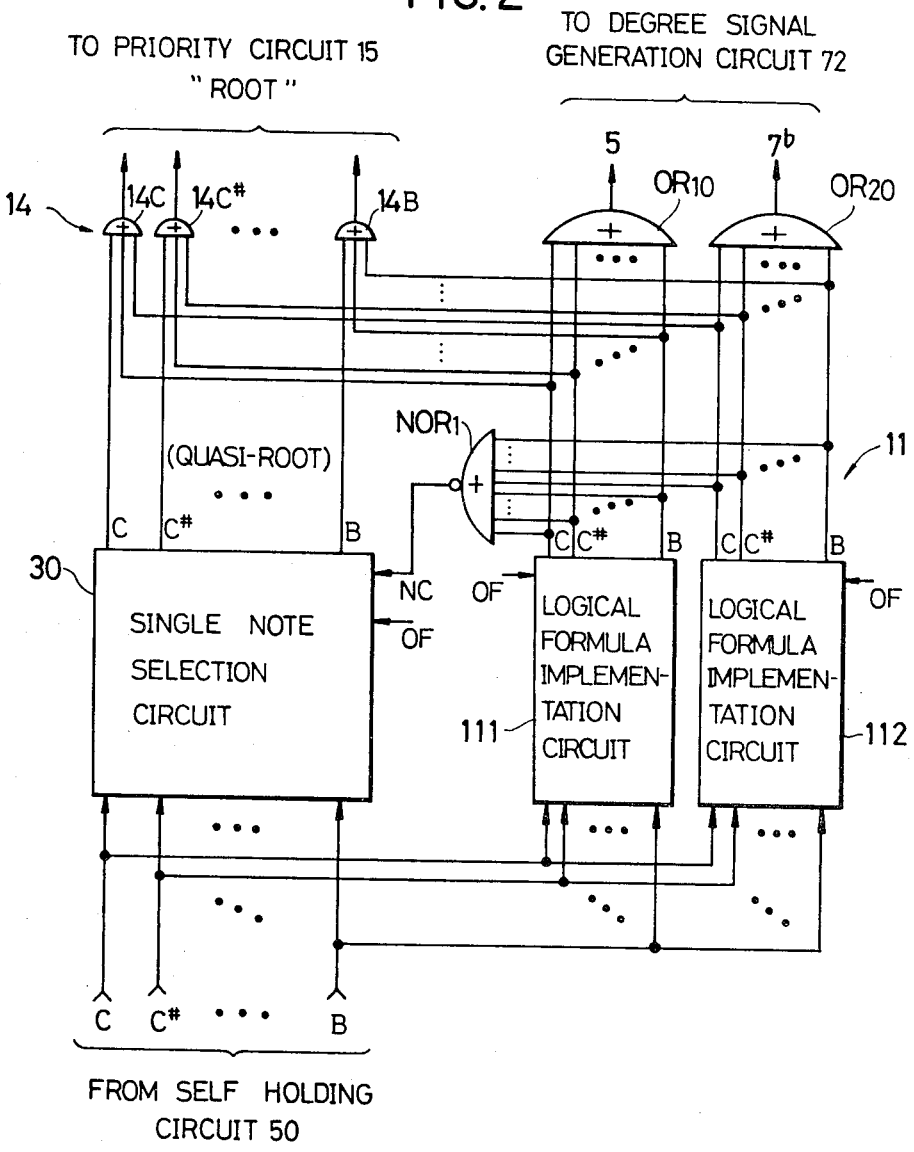
FIG. 2 is a block diagram showing in detail a minor seventh degree and perfect fifth degree discrimination and root selection circuit 11 of FIG. 1.
Figure 9:
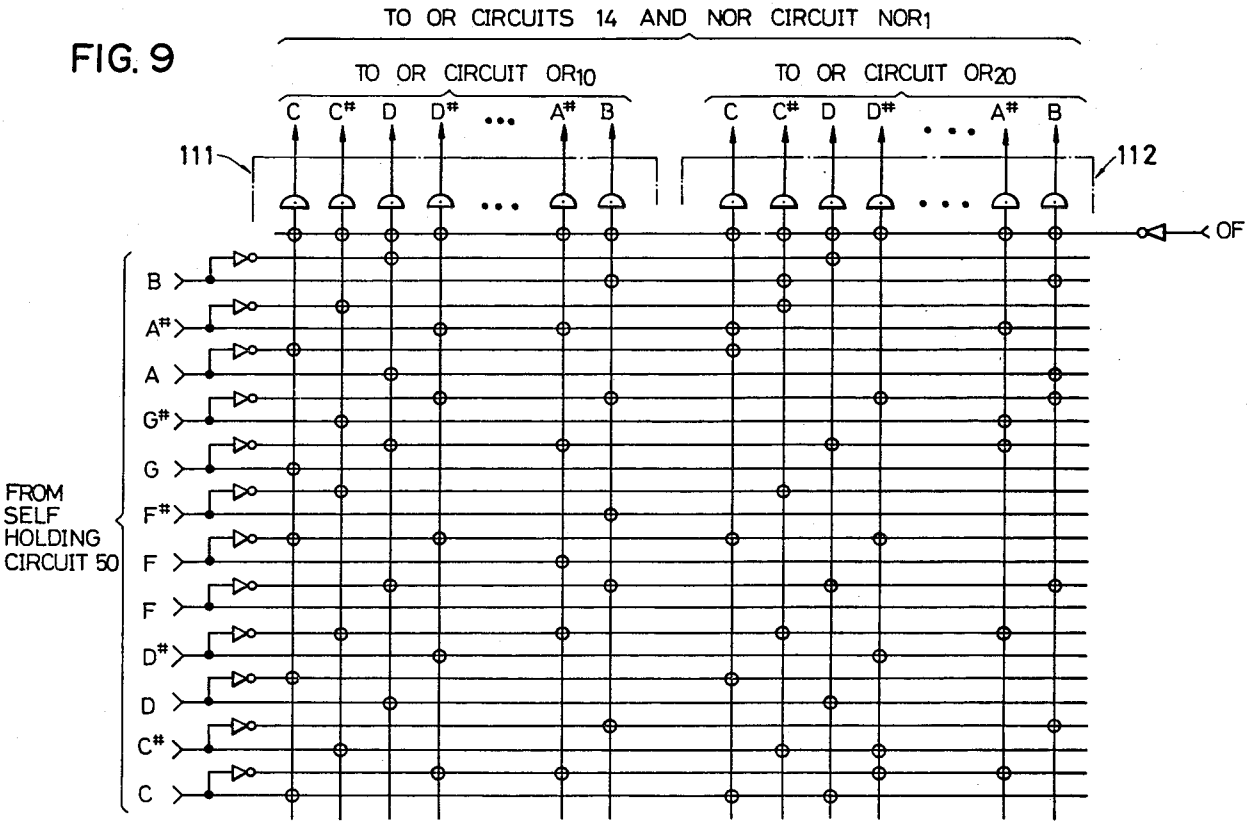
FIG. 9 is a circuit diagram showing specific examples of logical formula implementation circuits 111 and 112 of FIG. 2.
Figure 10:
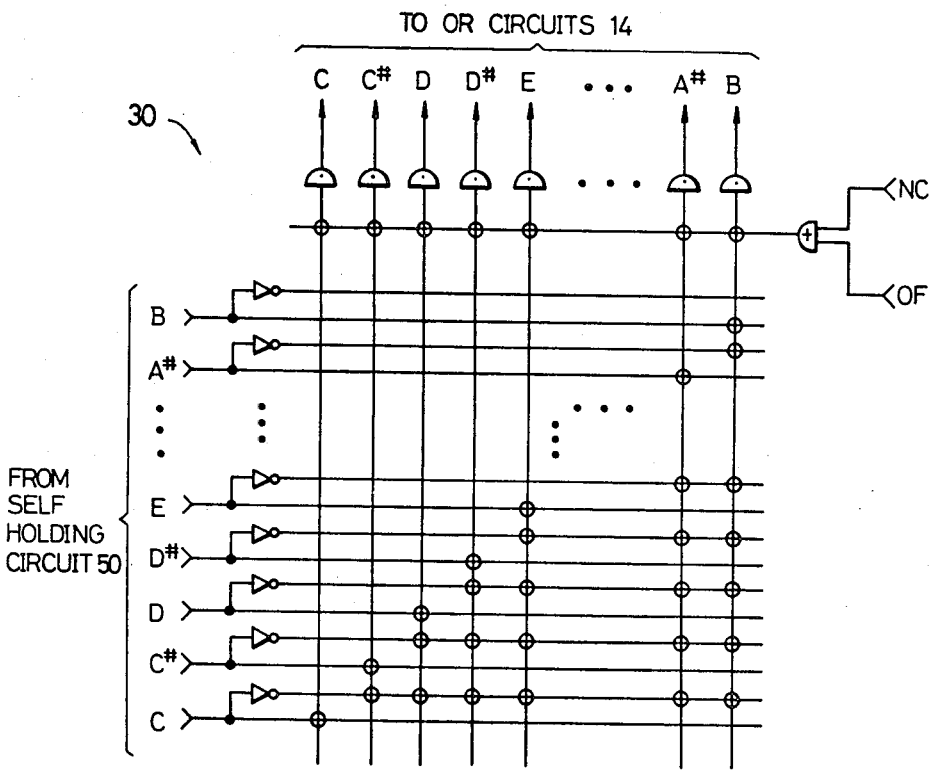
FIG. 10 is a circuit diagram showing a specific example of a single tone selection circuit 30 of FIG. 1.

In FIG. 2, a logical formula implementation circuit 111 included in the root selection circuit 11 is provided for carrying out the logical formula (1) and a logical formula implementation circuit 112 for carrying out the logical formula (2). Specific examples of the circuits 111, 112 are shown in FIG. 9. The circuits 111, 112 respectively have 12 AND circuits each of which is adapted to carry out the logical formula (1) or (2), using a corresponding one of the notes C-B of the twelve note scale as the root $K_1$. If these logical formulas are satisfied, a signal is produced on an output line corresponding to one of the notes C-B which is being used as the root $K_1$. This signal not only represents the note name of the root but constitutes the degree detection signal 5 representing detection of a chord of perfect fifth degree if the signal is produced from the circuit 111 and the degree detection signal $7^b$ representing detection of a chord of minor seventh degree if the signal is produced from the circuit 112. The output lines of the circuit 111 are connected to an OR circuit $OR_{10}$ to provide the degree detection signal 5 and the output lines of the circuit 112 are connected to an OR circuit $OR_{20}$ to provide the degree detection signal $7^b$. The outputs on the output lines of the notes C-B which correspond to the root are applied to corresponding OR circuits 14C, 14C# . . . 14B of OR circuit group 14 and are provided as the root selection signals. Further, all the outputs of the circuits 111, 112 are applied to a single NOR circuit $NOR_1$. Regardless of the note name of the root, if neither the logical formula (1) nor (2) is satisfied (i.e. if the depressed key does not constitute a chord of a perfect fifth degree or a minor seventh degree), the circuits 111, 112 do not produce the root selection signal. Accordingly, all the output lines of the circuits 111, 112 are signal "O" and the NOR circuit $NOR_1$ produces no-chord detection signal NC. The signal note selection circuit 30 is enabled in response to the no-chord detection signal NC and performs a selective operation with a certain predetermined priority order. The single note selection circuit 30 consists, for example of a low note priority circuit with the note C in the twelve notes scale being placed in the low note side. A specific example of the circuit 30 is shown in FIG. 10. The circuit 30 is logically designed in such a manner that it will select and output only one note of the low note side in precedence of other notes from among a plurality of input depressed key note name signals. For example, each logical circuit corresponding to each note of the twelve notes scale is enabled for one operation by the no-chord-detection signal NC and the output of a logical circuit for one note is inhibited by a depressed key note name signal input which is of a lower note than the one note. In this manner, selection of a single lower note in precedence of other notes is conducted when no chord name is detected.

The output lines for the respective notes C-B of the single note selection circuit 30 are connected to corresponding OR circuits 14C, 14C# . . . 14B. A quasi-root signal is produced only on an output line of a selected note. This quasi-root signal is applied to a priority circuit 15 through a corresponding OR circuit (14C–14B).

No root selection signal is produced from the circuits 111, 112 while a quasi-root signal is produced from the single note selection circuit 30. Accordingly, only a single quasi-root signal passes the priority circuit 15 and is provided from the chord name detection circuit 10. When the above described logical formulas (1) and (2) are satisfied, no quasi-root signal is produced but the root selection signal from the circuits 111, 112 is applied to the priority circuit 15 through the OR circuit group 14. If there occur plural root selection signals, the priority circuit 15 selects a signal of only one note name in accordance with a predetermined order of precedence (e.g. with priority given to a lower note) and outputs a single root signal. This priority circuit 15 is of a construction similar to that of the single note selection circuit 30 shown in FIG. 10. If, for example, a chord of $Cm_7$ (i.e. C minor seventh) is formed on the keyboard, keys of the notes C, D# and A# are depressed and, according to the logical formulas (1) and (2), a chord C having the note C as its root and A# as a note of minor seventh degree and a chord D# having the note D# as its root and A# as a note of perfect fifth degree are produced and therefore two root selection signals C and D# are produced. In this case, the priority circuit 15 selects and outputs the root signal C only. Thus, the priority circuit 15 produces a signal on only one of its output lines and this signal represents a root of a chord formed by depressed keys, or a quasi-root if no chord is detected.

The output lines of the priority circuit 15 are respectively connected to a major third degree detection circuit 12 and a minor third degree detection circuit 13. The circuits 12 and 13 are provided for detecting whether the key which is being depressed is of a major third degree or a minor third degree relative to the root $K_1$ detected and selected by the root selection circuit 11 and the priority circuit 15. This detection is made on the basis of the output of the priority circuit 15 and the depressed key note name signal from the keyboard circuit 40. Specific examples of the circuits 12, 13 are shown in FIG. 11. If a key having a note of major third degree relative to the root is being depressed, a major third degree detection signal 3 is produced, whereas if a key having a note of minor third degree relative to the root is being depressed, a minor third degree detection signal 3♭ is produced. In the above described manner, a chord name formed by the depressed keys (i.e. chord name designated by operation of the keys) can be discriminated depending upon the root signal produced on the output lines of the priority circuit 15 and representing the name of the root and the degree detection signals 3♭, 3, 5, 7♭ which respectively represent degrees of the notes which constitute the chord together with the root (hereinafter referred to as "subordinate notes"). If, for example, the chord is "major", the degree detection signals 3 and 5 will be produced as subordinate notes. If the chord is "minor", the degree detection signals 3♭ and 5 will be produced, and if the chord is "seventh", the degree detection signal 7♭ will be produced. In the case of the single key depression system, however, the chord name is discriminated only by the root signal from the single note selection circuit 30 and the kind of chord, i.e. the degree of the subordinate notes constituting the chord, is designated by a subordinate note degree designation circuit 71 as will be described in detail later.

The root signal provided by the chord name detection circuit 10 is applied to an encoder 21. A specific example of the encoder 21 is shown in FIG. 12. Twelve output lines for the notes C-B led from the chord name detection circuit 10 are connected to corresponding input terminals of encoders **21*a*–21*f*. The encoder 21 is provided for encoding each of the twelve notes C-B into specific binary information corresponding to the degree of the note relative to a certain reference note (e.g. C). If, for example, information of the note C is set at 1 and 1 is added for each semitone increase, numerical values 1–12 are allotted to the twelve notes C-B in the form of 4 bit binary information. The root encoders 21*a*, 21*f* are adapted to encode their root signal inputs into binary information representing the note names of the roots. The minor third degree encoder 21*b* encodes the root signal input into binary information representing a note name of minor third degrees relative to the root. Likewise, the major third degree encoder 21*c*, the fifth degree encoder 21*d* and the minor seventh degree encoder 21*e* respectively encode the root signal input into binary information representing note names of a major third degree, a perfect fifth degree and a minor seventh degree. Notwithstanding that the encoders 21*a*–21*e* encode the root signal input of the same note, these encoders 21*a*–21*e* have different constructions from each other. For example, the minor third degree encoder 21*b* is constructed in such a manner that its encoded information is a numerical value which is encoded information of the root encoder 21*a* plus 3; in the third degree encoder 21*c* its encoded information is a numerical value which is the encoded information of the root encoder 21*a* plus 4; in the fifth degree encoder 21*d*, its encoded information is the encoded information of the root encoder 21*a* plus 7; and in the minor seventh degree encoder 21*e*, its encoded information is the encoded information of the root encoder 21*a* plus 10. If the added numerical value n exceeds 12, the encoded numerical value will be n-12. An example of the encoded information is shown in the following Table I. It should be noted that the table shows numerical values in decimal notation but the encoder 21** outputs 4-bit binary information corresponding to these numerical values

TABLE I

| input | encoder output | | | | |
|---|---|---|---|---|---|
| name of root | root | $3^b$ degree | 3 degree | 5 degree | $7^b$ degree |
| C | 1 | 4 | 5 | 8 | 11 |
| C# | 2 | 5 | 6 | 9 | 12 |
| D | 3 | 6 | 7 | 10 | 1 |
| . | . | . | . | . | . |
| . | . | . | . | . | . |
| . | . | . | . | . | . |
| A | 11 | 2 | 3 | 6 | 9 |
| B | 12 | 3 | 4 | 7 | 10 |

In the above described manner, if a root signal of a certain note is applied from the chord name detection circuit 10, binary information representing the note of the root and all notes which can be subordinate notes to the root (i.e. notes of minor third degree, major third degree, perfect fifth degree and minor seventh degree) are simultaneously produced from the encoders 21*a*–21*e* and applied to the selection circuit 22.

A selection control unit 23 is provided for developing the notes (i.e. root and subordinate notes) constituting the chord designated by operation of the keys note by note (i.e. in the form of a broken chord) in a predetermined pattern of bass accompaniment. In the control unit 23, rhythm pulses $T_1$–$T_3$ (or $HT_1$–$HT_3$) are suitably assigned to each of the degrees constituting the respective chords in accordance with degree signals $S_{3b}$–$S_{7b}$ corresponding to the respective degrees. Selection in the selection circuit 22 of the binary information from the encoders 21*a*–21*e* is controlled by the output of the control unit 23. More specifically, the degree signals $S_{3b}$–$S_{7b}$ of the root and the subordinate notes to which the rhythm pulses $T_1$–$T_3$ (or $HT_1$–$HT_3$) have been assigned are applied to selection control input terminals of the selection circuit 22 as root selection pulse $P_1$ and subordinate note selection pulses $P_{3b}$–$P_{7b}$. The root selection pulse $P_1$ is used for selecting binary information from the root encoder 21*a*, and the subordinate selection pulses $P_{3b}$, $P_3$, $P_5$ and $P_{7b}$ are used for selecting binary information corresponding to minor third degree, major third degree, perfect fifth degree and minor seventh degree from the encoders 21*b*–21*e*.

A rhythm pulse generator 24 is a circuit for generating the rhythm pulses $T_1$, $T_2$ and $T_3$ which determine the sound timing of the bass tone with a certain time interval and in accordance with a predetermined rhythm. The mode of generation of the rhythm pulses $T_1$–$T_3$, i.e. the kind of rhythm, can be determined as desired.

A degree signal generation circuit 72 is a circuit for generating a degree signal indicating the degree of each chord designated by operation of the keys. In the case of the plural keys depression system, subordinate note degree signals $S_{3b}$–$S_{7b}$ are generated depending upon presence of the degree detection signals $3_b$–$7_b$ from the chord name detection circuit 10. In the case of the single key depression system, the subordinate note degree signals $S_{3b}$–$S_{7b}$ are generated in response to degree designation signals $F_1$ and $F_2$ from a subordinate note degree designation circuit 71. Since the degree of the root is the same for any kind of chord (major, minor or seventh), the circuit 72 does not produce a degree signal for the root. In the selection control unit 23, the root selection pulse $P_1$ is generated by assigning a necessary rhythm pulse ($T_1$–$T_3$) on the assumption that a root degree signal is constantly applied to the control unit 23, though no output line for the root degree signal is shown in the figure. In the case of the plural keys depression system the degree of a designated chord is known by presence or absence of the degree detection signals $3_b$–$7_b$. However, the kind of degree cannot be known by the depression of the key in a case where the single key depression system is employed. The subordinate note degree designation circuit 71 therefore is provided for designating the kind of the degree of the subordinate note (i.e. major, minor, seventh). This circuit 71 comprises a suitable device such as an operation lever for designating the kind of chord. The kind of chord is determined by operation of this device and by depression of the key on the keyboard which designates the root. The degree designation signals $F_1$, $F_2$ are 2-bit binary data produced by operation of the above described device. Relations between contents of the signals $F_1$, $F_2$ and the kind of chord are shown in the following Table II.

TABLE II

| Kind of chord | $F_1$ | $F_2$ |
|---|---|---|
| major | 1 | 1 |
| minor | 0 | 1 |
| seventh | 1 | 0 |
| minor seventh | 0 | 0 |

The subordinate note degree designation circuit 71 produces, if necessary, a signal OF used for designating the single key depression system. Upon receipt of the signal OF, the degree signal generation circuit 72 generates the degree signals $S_{3b}$–$S_{7b}$ in accordance with the degree designation signals $F_1$, $F_2$ supplied from the circuit 71.

A bass variation setting circuit 73 is a circuit provided for determining a note of what degree should be sounded as a bass tone. For this purpose, the circuit 72 outputs bass variation designation signals $V_1$, $V_2$. If notes of all degrees constituting a chord are sounded as a bass tone, the bass accompaniment will give a feeling of monotonousness to the audience. To avoid such monotonousness and give variety to the bass accompaniment, kinds of degrees used as a bass tone are limited depending upon the kind of music or rhythm. The variation designation signals $V_1$, $V_2$ are 2-bit binary data and relations between contents of the signals $V_1$, $V_2$ and sounding variation (note of what degree should be used as the bass tone) are illustrated by way of example in Table III.

TABLE III

| degree | sounding variation $V_1$ | $V_2$ |
|---|---|---|
| 1 | 0 | 0 |
| 1. 5. | 0 | 1 |
| 1. $3^b$. 3. 5. | 1 | 0 |
| 1. $3^b$. 3. 5. $7^b$ | 1 | 1 |

When, for example, the signals $V_1$, $V_2$ are 0, 0, the note of the first degree (i.e. root) is sounded as a bass tone.

Figure 3:
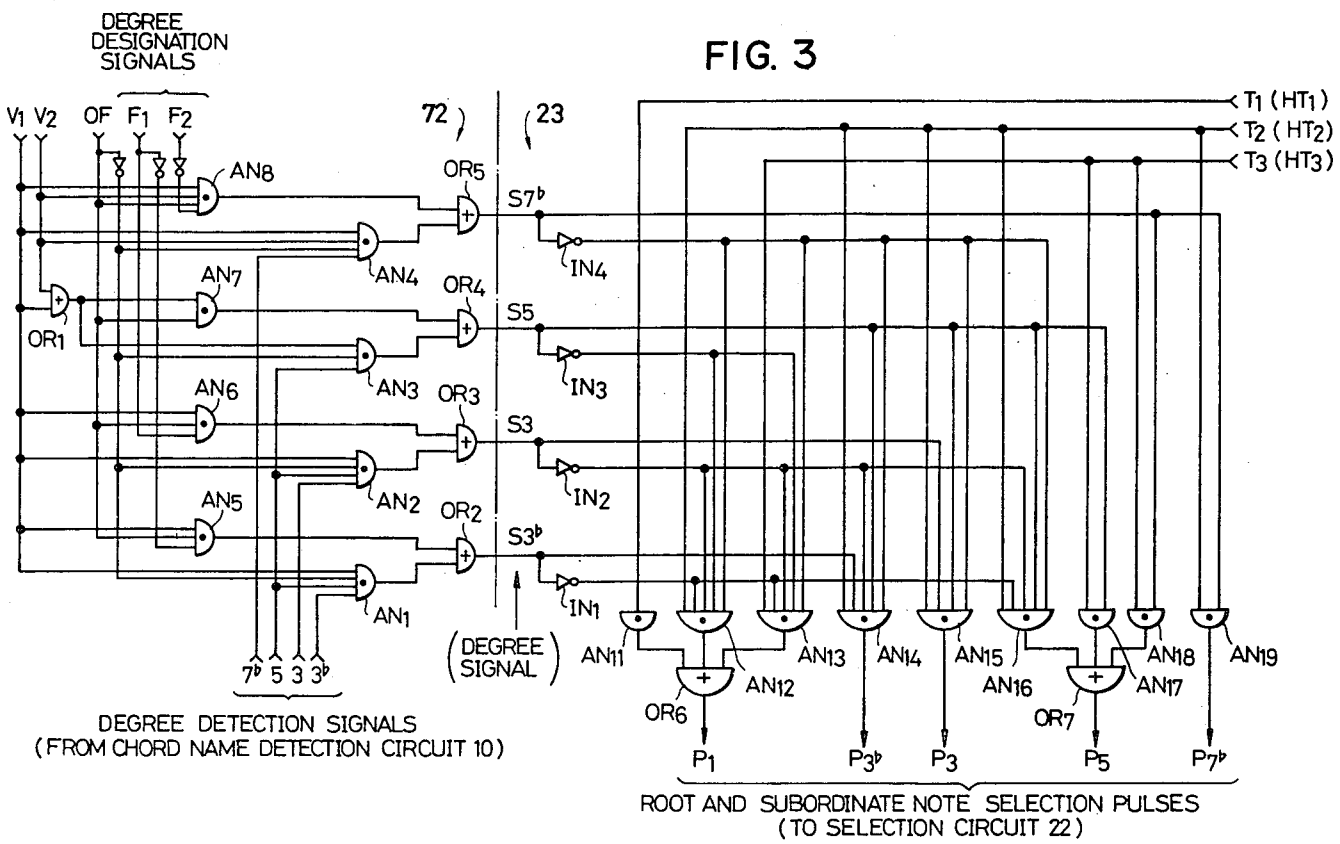
FIG. 3 is a circuit diagram showing in detail a degree signal generation circuit 72 and a selection control unit 23 of FIG. 1.

FIG. 3 shows a specific example of the degree signal generation circuit 72 and the selection control unit 23. In the case of the plural keys depression system, logical formulas for producing the degree signals $S_{3b}$–$S_{7b}$ by the degree signal generation circuit 72 are given hereinbelow as (a), (b), (c) and (d). For carrying out these formulas (a)–(d), AND circuits $AN_1$–$AN_4$ and OR circuit $OR_1$ are provided.

(a) degree signal $S_{3b}$ of minor third degree $= 3^b . 5 . V_1 . \overline{OF}$ ..... AND circuit $AN_1$ (b) degree signal $S_3$ of major third degree $= 3 . 5 . V_1 . \overline{OF}$ ..... AND circuit $AN_2$ (c) degree signal $S_5$ of perfect fifth degree $= 5 . (V_1 + V_2) . \overline{OF}$ ..... AND circuit $AN_3$ $\longrightarrow$ OR circuit $OR_1$ (d) degree signal $S_{7b}$ of minor seventh degree -continued $= 7^b \cdot V_1 \cdot V_2 \cdot \overline{OF}$ ..... AND circuit $AN_4$ In the above formulas, $\overline{OF}$ represents absence of the single key depression system order signal OF. The signal $\overline{OF}$ is obtained by inverting the order signal OF through an inverter.

If the single key depression system is used, the degree detection signals $3^b$–$7^b$ are not utilized (these signals $3^b$–$7^b$ are not produced) but the degree designation signals $F_1$, $F_2$ from the subordinate note degree designation circuit 71 are utilized. In this case, the degree signals $S_{3b}$–$S_{7b}$ are generated according to the following logical formulas (e)–(h). For carrying out these logical formulas, AND circuits $AN_5$–$AN_8$ are provided.

(e) $S_{3b}=\overline{F_1}\cdot V_1\cdot OF$ . . . AND circuit $AN_5$ (f) $S_3=F_1\cdot V_1\cdot OF$ . . . AND circuit $AN_6$ (g) $S_5=(V_1+V_2)\cdot OF$ . . . AND circuit $AN_7$ (h) $S_{7b}=\overline{F_2}\cdot V_1\cdot V_2\cdot OF$ . . . AND circuit $AN_8$ If a certain chord is designated by operation of the keys, either of the AND circuit group $AN_1$–$AN_4$ or the AND circuit group $AN_5$–$AN_8$ is enabled and the output thereof is supplied through OR circuits $OR_2$–$OR_5$ to the selection control unit 23 as the degree signals $S_{3b}$–$S_{7b}$. The kind of the subordinate note constituting this chord differs depending upon the kind of the designated chord. Accordingly, the degree signals $S_{3b}$–$S_{7b}$ b are produced in the form corresponding to the degree of the chord (and according to contents of the variation designation signals $V_1$, $V_2$).

Assignment of the rhythm pulses $T_1$–$T_3$ to the respective degree signals $S_{3b}$–$S_{7b}$ in the selection control unit 23 is conducted under some predetermined conditions. These conditions are expressed in the following logical formulas (3)–(11). When one of these logical formulas is satisfied, root and subordinate note selection pulses $P_1$–$P_{7b}$ concerning the particular formula is produced. Contents in parenthesis in these logical formulas (3)–(11) show conditions under which the degree signals $S_{3b}$–$S_{7b}$ are produced in assigning the rhythm pulses $T_1$–$T_3$ to the degrees.

Root selection pulse $P_1$ $T_1$ (3)

AND circuit $AN_{11}$ $T_2 \cdot (\overline{S_{3b}} \cdot \overline{S_3} \cdot \overline{S_5} \cdot \overline{S_{7b}})$ (4)

AND circuit $AN_{12}$ $T_3 \cdot (\overline{S_{3b}} \cdot \overline{S_3} \cdot \overline{S_5} \cdot \overline{S_{7b}})$ (5)

AND circuit $AN_{13}$

Minor third degree selection pulse $P_{3b}$ $T_2 \cdot (\overline{S_{3b}} \cdot \overline{S_3} \cdot \overline{S_5} \cdot \overline{S_{7b}})$ (6)

AND circuit $AN_{14}$

Major third degree selection pulse $P_3$ $T_2 \cdot (S_3 \cdot S_5 \cdot \overline{S_{7b}})$ (7)

AND circuit $AN_{15}$

Perfect fifth degree selection pulse $P_5$ $T_2 \cdot (\overline{S_{3b}} \cdot \overline{S_3} \cdot S_5 \cdot \overline{S_{7b}})$ (8)

AND circuit $AN_{16}$ $T_3 \cdot (S_5)$ (9)

AND circuit $AN_{17}$ $T_3 \cdot (S_{7b})$ (10)

AND circuit $AN_{18}$

-continued

Minor seventh degree selection pulse $P_{7b}$ $T_2 \cdot (S_{7b})$ (11)

AND circuit $AN_{19}$

The AND circuits $AN_{11}$–$AN_{19}$ are provided for implementing the logical formulas (3)–(11). In these formulas, $\overline{S_{3b}}$, $\overline{S_3}$, $\overline{S_5}$ and $\overline{S_{7b}}$, indicating absence of the degree signals $S_{3b}$, $S_3$, $S_5$ and $S_{7b}$, are supplied from inverters $IN_1$–$IN_4$. In a case where plural rhythm pulses are assigned to the same degree as in the logical formulas (3)–(5), (8)–(10), the outputs of the corresponding AND circuits are connected to OR circuits $OR_6$ and $OR_7$ and selection pulses $P_1$, $P_5$ are produced on single output lines of the OR circuits $OR_6$ and $OR_7$.

As will be apparent from the above, a bass accompaniment pattern suitable for the kind of chord is considered in assigning the rhythm pulses $T_1$–$T_3$.

Let us assume that the rhythm pulses are generated one by one in the order of $T_1$, $T_2$, $T_3$. If the chord formed by the depressed keys is C(i.e. C major), the logical formulas (3), (7) and (9) are satisified and the root and subordinate selection pulses are generated in the order of $P_1$, $P_3$, $P_5$. Accordingly, binary information from the root encoder 21*a*, the major third degree encoder 21*c* and the perfect fifth degree encoder 21*d* is selected one after another in the selection circuit 22. Since the root in this case is C, binary information corresponding to the notes of C, E, G is sequentially applied to a hold circuit 25. The hold circuit 25 holds the binary information until next application of binary information.

If the chord is $D_7$ (D seventh), the logical formulas (1), (10) and (11) are satisfied and the root and subordinate note selection pulses are generated in the order of $P_1$, $P_{7b}$, $P_5$. In this case, the chord is formed in the order of the root, minor seventh degree, the perfect fifth degree. Since the root in this case is D, binary information corresponding to the notes D, C, A, is applied to the hold circuit 25 through the selection circuit 22.

Next to be described is a case where a chord which is not detectable by the chord name detection circuit 10 (e.g. a chord of major sixth degree) is formed by depression of keys. Assume now that keys of root $K_1$, perfect fifth degree $K_5$ and major sixth degree $K_6$ are being depressed. Since the logical formulas (1) and (2) are not satisfied, degree detection signals 5, $7^b$ are not produced. Further, third degree interval detection signals $3^b$, 3 are not produced. Accordingly, the logical formulas (4) and (5) are satisfied with a result that the selection pulses are generated in the order of $P_1 \rightarrow P_1 \rightarrow P_1$. Since the single note selection circuit 30 selects a quasi-root of a single note (in the above case, the lowest note of $K_1$, $K_5$, $K_6$), the encoder 21 receives an input corresponding to the note of the quasi-root. If, for example, the chord is $F_6$, keys of F, C and D are being depressed and the single note selection circuit 30 selects the note C which is the lowest note among the notes of the depressed keys as the quasi-root. Accordingly, binary information corresponding to the note C is applied to the hold circuit 25 at the timing of the rhythm pulses $T_1$, $T_2$ and $T_3$.

If keys of the root, minor third degree and major sixth degree are being depressed, the logical formulas (4), (5) are not satisified so that the root selection pulse $P_1$ only is produced at the timing of the rhythm pulse $T_1$. If, for example, the chord $F_m6$ is designated, keys F, G# and D are being depressed and the single note selection circuit 30 selects the note D which is the lowest note as the quasi-root. Accordingly, binary information corresponding to the note D is applied to the hold circuit 25 only at the timing of the rhythm pulse $T_1$ and held in the hold circuit 25. If the chord remains unchanged during one measure, the binary information of the note D is held in the hold circuit 25 during this one measure.

The rhythm pulses $T_1$–$T_3$ received in the selection control unit 23 at a certain timing may be temporarily held in the unit 23 until the pulses $T_1$–$T_3$ are applied at a next timing so that the rhythm pulses $T_1$–$T_3$ may be converted to continuous hold rhythm pulses $HT_1$–$HT_3$ and utilized in the AND circuits $AN_{11}$–$AN_{19}$ in place of the rhythm pulses $T_1$–$T_3$ in the logical formulas (3)–(11). This arrangement will obviate provision of another hold circuit for holding the selection pulses $P_1$–$P_{7\flat}$ and thereby making them synchronous with signals which are already held in the hold circuit 25 in a case where the selection pulses $P_1$–$P_{7\flat}$ are used in a circuit after the hold circuit 25 as will be described later. In the above described example, however, the selection pulses $P_1$–$P_{7\flat}$ are not used in such a manner and description will be made on the assumption that the rhythm pulses $T_1$–$T_3$ are used without being converted to the hold rhythm pulses $HT_1$–$HT_3$.

Figure 4:
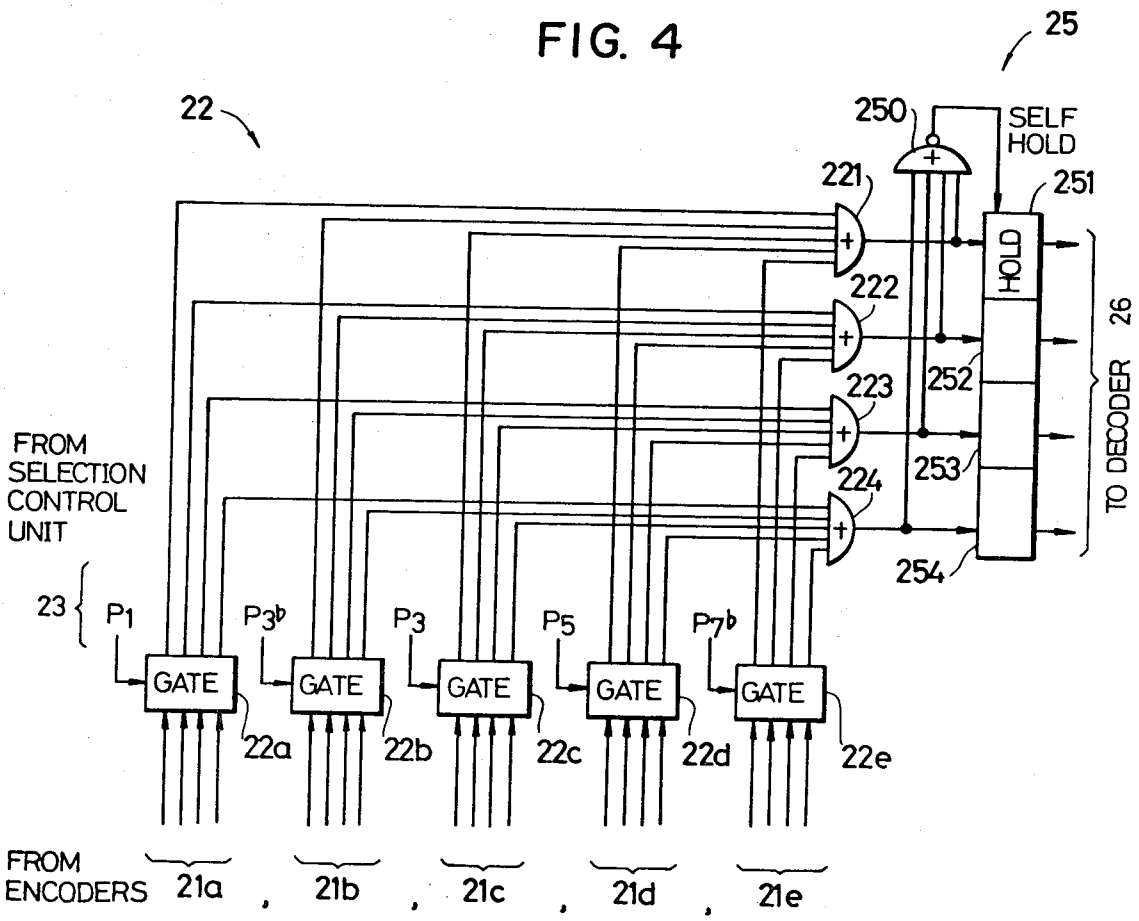
FIG. 4 is a block diagram showing a selection circuit 22 of FIG. 1 in detail.

As shown in FIG. 4, the selection circuit 22 comprises gate circuit **22*a*–22*e* which respectively receive binary information from the encoders 21*a*–21*e*. These gate circuits 22*a*–22*e* are enabled by the root and subordinate note selection pulses $P_1$–$P_{7\flat}$ corresponding to the degrees represented by the respective input binary information. In the case of a major chord, the root selection pulse $P_1$ first enables the gate circuit 22*a* at the timing of the rhythm pulse $T_1$ and thereby causes the binary information from the root encoder 21*a* to be selected and applied to the hold circuit 25 through OR circuits 221–224. Nextly, the major third degree selection pulse $P_3$ enables the gate circuit 22*c* at the timing of the rhythm pulse $T_2$ and thereby causes the binary information from the third degree encoder 21*c* to be selected. At the timing of the rhythm pulse $T_3$, the perfect fifth degree selection pulse $P_5$ enables the gate circuit 22*d* causing binary information from the fifth degree encoder 21*d*** to be selected. In the foregoing manner, binary information representing the root and subordinate notes of a chord is selected in accordance with a desired bass accompaniment.

Since the binary information applied to the hold circuit 25 is only one system of 4 bit information, the hold circuit 25 may only include the circuits 251–254. The hold circuits 251–254 are self-holding circuits of a type in which its outputs are fed back to its input side by using a memory device such as a flip-flop. When a NOR circuit 250 has detected absence of binary information from the selection circuit 22, the holding circuits 251–254 perform self-holding operation. Accordingly, binary information applied to the hold circuit 25 is held therein until next binary information is applied thereto. For example, in the case of the above described major chord, the binary information of the root applied at the timing of the rhythm pulse $T_1$ is held until binary information representing the note of the major third degree is applied at the timing of the rhythm pulse $T_2$.

It will be appreciated from the foregoing description that the apparatus according to the invention has only to include hold circuits 25 (251–254) equal in number to the bit number of the binary information. The number of the hold circuits is considerably reduced as compared with the prior art apparatus in which a hold circuit must be provided for each of the chords to be played. Besides, according to the invention, the gates of the selection circuit 22 can be provided only for the root and the kinds of the subordinate notes. Since the binary information of the root and subordinate notes of a single chord is supplied from the encoder 21 the gate circuit **22*a*–22*e*** provided for selecting information of the root and the same kind (interval) of subordinate note can be commonly used regardless of the name of the chord. Accordingly, the number of the gates is remarkably reduced in the apparatus according to the invention.

A decoder 26 decodes the binary information supplied from the hold circuit 25 and outputs it to the output lines corresponding to the selected notes (C, C♯ . . . B) and supplies the decoded note information to a tone generator 27. The tone generator 27 is a circuit provided for generating a bass tone signal frequency which is suitable for the note information supplied from the decoder 26. The tone generator 27 may comprise oscillators corresponding to the respective note frequencies or a plurality of frequency dividing circuits. The tone generator 27 may also be constructed in such a manner that the frequency dividing ratio of a single frequency dividing circuit may be varied in accordance with the input note information. The output of the tone generator 27 is applied to a gate circuit 28 for analog signals and delivered out of the gate circuit 28 at the timing of generation of bass tone generation control pulses BG. Bass tone is produced from this output through a suitable sound system (not shown). The bass tone generation control pulses BG are generated in synchronization with generation of the rhythm pulses $T_1$, $T_2$ and $T_3$ in the rhythm pulse generator 24 and, accordingly, the bass tone is sounded in synchronization with generation of the rhythm pulses $T_1$, $T_2$ and $T_3$.

Assuming that a chord is developed $C \rightarrow Fm_6 \rightarrow D_7$ in performance of a music piece, the bass accompaniment proceeds as shown in the following Table IV:

TABLE IV

| chord name | C → | → $Fm_6$ → | → $D_7$ |
|---|---|---|---|
| bass note | C → E → G | D → D → D | D → C → A |

Accordingly, the bass tone proceeds without conflicting with the development of the chord (or melody), which is natural from the musical standpoint. In the prior art device, development of chord C is repeated in the measure of chord $Fm_6$ and a bass tone G which is the last bass tone in the development of chord C is used in a measure of chord $Fm_6$. In such a case, the base accompaniment is contradictory with the chord $Fm_6$, as will be apparent from the Table IV.

In the above described embodiment, a note selected as a quasi-root is sounded as the bass tone when no chord name has been detected. Alternatively, the bass accompaniment may proceed by a fictitious chord development. For example, a chord of major sixth degree can be replaced by a chord of fifth degree without giving an unnatural impression (i.e. if, for example, a bass accompaniment by chord $C_6$ is desirable, a bass accompaniment by chord C does not give an unnatural impression). For achieving such fictitious chord development, a circuit may be provided for automatically generating the root and subordinate note selection pulses $P_1$, $P_{3\flat}$, $P_3$, $P_5$ and $P_{7\flat}$ as desired irrespective of the degree detection signals $3^\flat$–$7^\flat$ supplied from the detection circuit 10, and the selection pulses may be applied to the selection circuit 22 to carry out the bass accompaniment by a fictitious chord development.

In the case of the plural keys depression system, a plurality of keys are depressed on the keyboard and, accordingly, the notes of these depressed keys may be simultaneously sounced by a separate circuit (not shown) to conduct chord performance. In the case of the single key depression system, however, an extra circuit must be provided for automatically conducting chord performance. More specifically, the output of the root encoder 21f is applied to a hold circuit 61 and self-held therein and thereafter is decoded in a decoder 62 to provide an output corresponding to the root on one of output lines (C–B). This decoded output is applied to a root tone generator 63, a third degree and minor third degree tone generator 64 and a fifth degree and minor seventh degree tone generator 65. The root tone generator 63 outputs a frequency signal corresponding to the root. The major third degree and minor third degree tone generator 64 selectively outputs a frequency signal of a note of a major third degree or a minor third degree relative to the root. When a control signal $F_3$ applied from outside designates a major chord, the tone generator 64 produces the frequency signal of the major third degree, whereas when the control signal $F_3$ designates a minor chord, the tone generator 64 produces the frequency signal of the minor third degree. The fifth degree and minor seventh degree tone generator 65 selectively outputs a frequency signal of a note of a perfect fifth degree or minor seventh degree relative to the root. When a control signal $F_4$ designates a chord of fifth degree, the tone generator 65 produces the frequency signal of the perfect fifth degree, whereas when the control signal $F_4$ designates a seventh chord, the tone generator 65 produces the frequency signal of the minor seventh degree. The output signals of the tone generators 63–65 are applied to gate circuits 66–68 for analog signals. The gate circuits 66–68 are enabled upon application of chord sound control pulses CG to provide the signals from the tone generators (63–65 to a sound system (not shown) for sounding as the chord. The chord sound control pulses CG which are used for timing of sounding of the chord are generated in the rhythm pulse generator 24 only when the single key depression system is used and have no particular relation with generation of the rhythm pulses $T_1$–$T_3$.

In the above described embodiment, a tone range within which bass tone can be played is one octave. According to this embodiment, even if the kind of chord and degrees of the root and the subordinate notes remain unchanged, a different mode of degree change will take place if the chord name changes. Assume, for example, that a bass tone is to be played with notes of first, third and fifth degrees. If the root is on a lower note side within one octave range, the bass tone is played with its degree rising gradually from the first degree to the third degree and then to the fifth degree. If, however, the root is in the middle of the octave range, the degree rises from the first degree to the third degree and then the fifth degree shifts to the lower note side of the same octave (i.e. one octave lower than the note of the desired fifth degree). If, the root is on the higher note side in the octave, notes of the third and the fifth degrees shift to the lower note side of the same octave.

Figure 5:
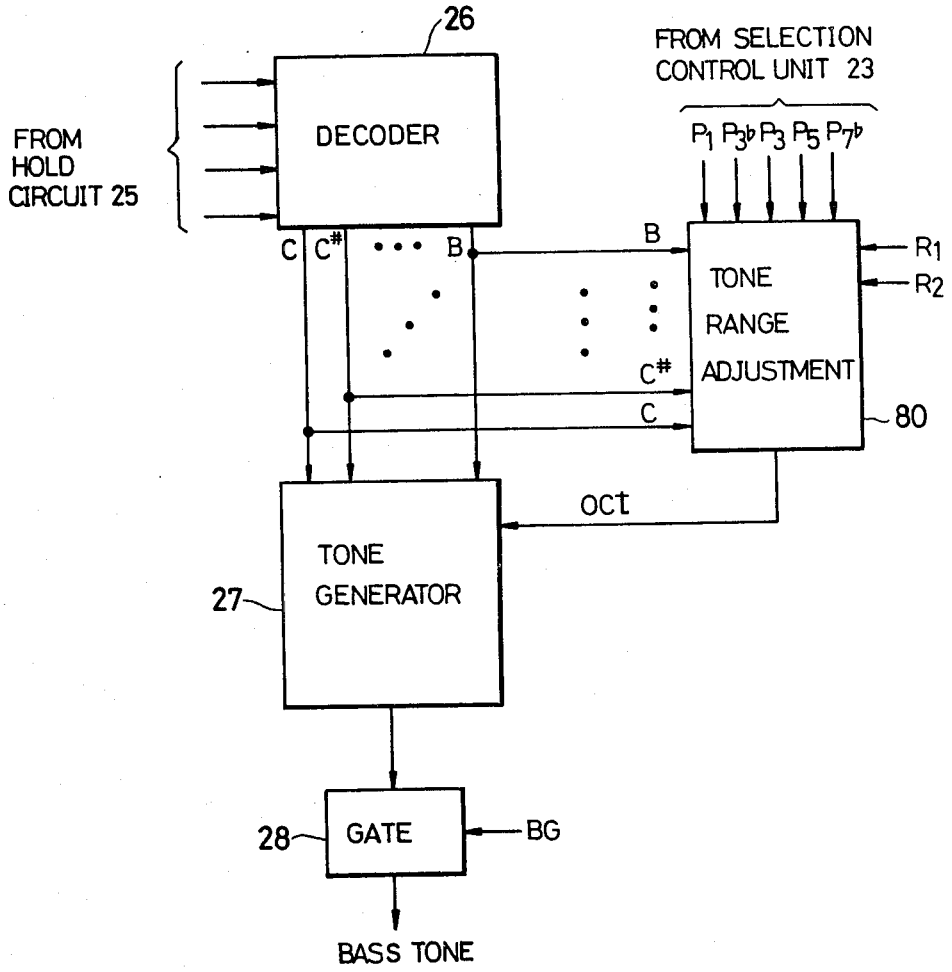
FIG. 5 is a block diagram showing another embodiment of the automatic accompaniment apparatus according to the invention.

An embodiment which has eliminated the above described defect is shown in FIG. 5. In this improved embodiment, plural octaves are used as the octave range within which a bass tone can be played. In order to accurately simulate a predetermined bass accompaniment pattern corresponding to the kind of rhythm or chord, the octave range of a note to be played is detected in response to a predetermined mode of change and a note frequency of the detected octave range is generated so that the octave range of the bass tone to be played is always adjusted. The present embodiment shown in FIG. 5 is different from the previously described embodiment in that the present embodiment additionally comprises a tone range adjustment circuit 80. Accordingly, description of the circuit construction which is the same as that of the previously described embodiment will be omitted.

With reference to FIG. 5, twelve output lines C-B of a decoder 26 are connected to a tone generator 27 and a tone range adjustment circuit 80. The tone range adjustment circuit 80 detects, on the basis of the root and subordinate note selection pulses $P_1$–$P_{7b}$, what degree in the chord corresponds to the note represented by the output on one of the output lines C-B and also what octave range is most suitable for the detected note when considered in relation to degree change information $R_1$, $R_2$, and thereupon produces an octave range designation signal oct.. As will be more fully described hereinafter, the degree change information $R_1$, $R_2$ has contents corresponding to each of rhythms to be played and, accordingly, the contents of the information $R_1$, $R_2$ are determined when a particular rhythm is selected. As has previously been described, the selection pulses $P_1$–$P_{7b}$ are generated in accordance with a required bass accompaniment pattern (i.e. a pattern of bass tone sounding timing and degree change except a rise or fall pattern of the degree change), and binary information of the required note is selected in response to the pulses $P_1$–$P_{7b}$ and decoded in the decoder 26. Accordingly the note signals appearing on the output lines of the decoder 26 simulate the bass accompaniment pattern with respect to the timing of generation of the respective degrees constituting the bass tone but are incapable of detecting whether a particular degree change is a rise pattern or a fall pattern. The tone range adjustment circuit 80 is provided for designating, in response to the information $R_1$, $R_2$ which designate rise or fall of the degree change, an octave range within which the bass tone is to be played, and thereby achieving a close simulation of the rise or fall pattern of bass tone degree change which is peculiar to a particular kind of chord or rhythm.

Examples of bass accompaniment patterns corresponding to rhythms are shown in the following Table V.

TABLE V

| Range of notes to be used / Kind of rhythm | Bass accompaniment patterns: Kinds of degrees to be played (degree) $F_1$ ~ $F_2$ | $G_1\#$ ~ $G_2$ | $A_1$ ~ $G_2\#$ | $C_1$ ~ $B_2$ | $A_1\#$ ~ $A_2$ | $G_1\#$ ~ $A_2$ | $F_1$ ~ $A_2$ | Rise and fall patterns of degree change | $R_1$ | $R_2$ |
|---|---|---|---|---|---|---|---|---|---|---|
| slow rock I | 1 | | | | | | | | | |
| jazz I | 1 | | | | | | | | 0 | 0 |
| tango I | 1 | | | | | | | | | |
| bolero | 1 | | 5 | | | | | 1 → 5 rise | | |
| mambo | 1 | | 5 | | | | | | 0 | 0 |
| jazz II | 1 | | 5 | | | | | | | |
| waltz | | | | | 1 | | 5 | | | |
| swing | | | | | 1 | | 5 | 1 fall → 5 | 1 | 0 |
| samba | | | | | 1 | | | | | |
| bossa nova | | | | | 1 | | 5 | | | |
| slow rock II | 1 | $3^b$ | 3 | 5 | 1 | $7^b$ | 5 | | | |
| beguine | 1 | $3^b$ | 3 | 5 | 1 | $7^b$ | 5 | 1 → 3 → 5 rise or fall | 0 | 1 |
| rumba | 1 | $3^b$ | 3 | 5 | 1 | $7^b$ | 5 | | | |
| tango II | 1 | $3^b$ | 3 | 5 | 1 | $7^b$ | 5 | 7 → 5 | | |

In the Table V, no timing of sounding is shown. The figures 1, 3$^b$ 3, and 7$^b$ appearing in the column of "kinds of degrees to be played" designate degrees, and the notes appearing in the column of "Ranges of notes to be used" designate a tone range to which the degrees to be used belong. The figures of information $R_1$, $R_2$ (2-bit binary data of 1 and 0) appearing in the column of "Rise and fall patterns of degree change" represent contents of the information $R_1$, $R_2$ designated in the particular rhythm. In the case of the "rise" pattern, a degree which coincides with a nominal 1 degree is actually produced between the root (first degree) and its subordinate note, whereas in the case of the "fall" pattern, no degree coinciding with a nominal degree is produced. Take, for example, a case of the fall pattern of first and fifth degrees. The actual degree between the two notes in this case is fourth degree and, accordingly, the subordinate note of the fifth degree relative to the root actually is a note which is fourth degree lower than the root. According to the Table V, the tone range within which the bass tone can be played is two octaves. Patterns of the tone range available for the bass accompaniment patterns shown in Table V are as shown in FIG. 6.

Figure 6:
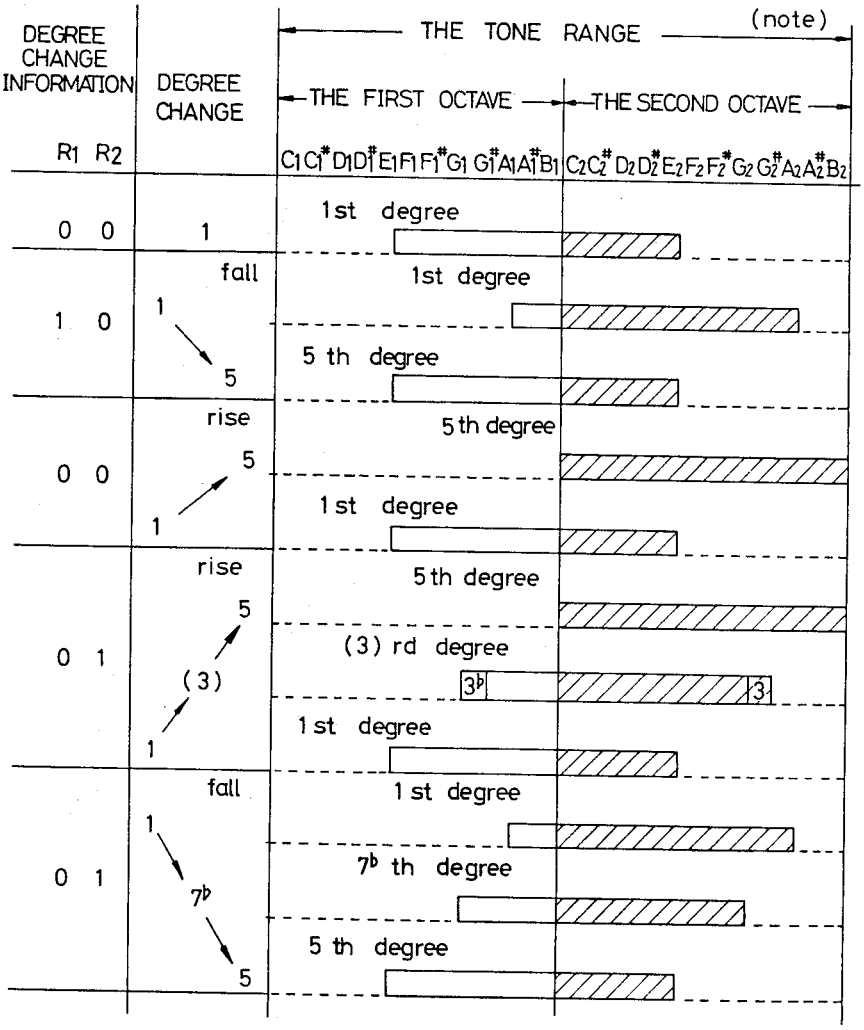
FIG. 6 is a diagram for explaining the operation principle of the embodiment shown in FIG. 5.

In FIG. 6 bar-like portions represent patterns of the tone range available for playing. More specifically, the bar-like portions represent a range of notes within which a note of a particular degree is to be played in the degree change pattern designated by the degree change information $R_1$, $R_2$. The shadowed portion in each bar-like portion represents that a note within this portion is sounded as a note in the second octave, whereas the blank portion represents that a note within this portion is sounded as a note in the first octave.

The tone range adjustment circuit 80 discriminates whether the note signal applied from the decoder 26 should be sounded in the first octave range or in the second octave range and produces the octave range designation signal oct. If, for example, the signal oct is a logical value "0", the first octave range is designated, whereas if the signal oct is a logical value "1", the second octave is designated.

Figure 7:
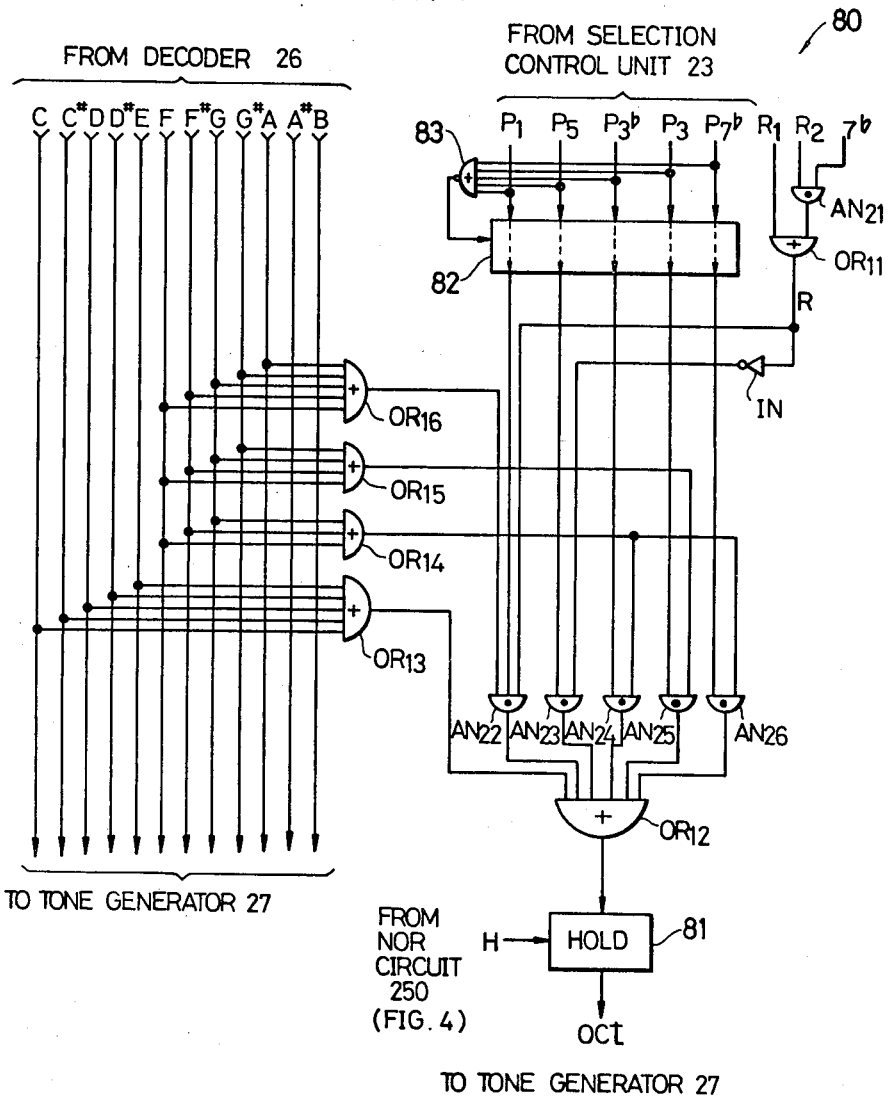
FIG. 7 is a circuit diagram showing a tone range adjustment circuit 80 of FIG. 5 in detail.

FIG. 7 shows an example of the tone range adjustment circuit 80 in detail. The circuit is constructed in such a manner that the tone range is adjusted to the tone shown in FIG. 6. The octave range designation signal oct normally is the logical value "0" designating the first octave range and becomes logical value "1" designating the second octave range when necessary. First degree change designation signal R for finally designating the degree change pattern is produced on the basis of the degree change information $R_1$, $R_2$ and the minor seventh degree detection signal $7^b$. A logical formula for producing this signal R is $$R = R_1 + R_2 \cdot 7^b \quad (12)$$

An OR circuit $OR_{11}$ and an AND circuit $AN_{21}$ are provided for carrying out this logical formula (12). When the signal R is logical value "1", the "fall pattern" is designated, whereas when the signal R is logical value "0", the "rise pattern" is designated. As will be apparent from FIG. 6, the "fall pattern" between first degree and fifth degree is designated when the information $R_1$ is logical value "1". Accordingly, the information $R_1$ is applied directly to the OR circuit $OR_1$. When the information $R_2$ is logical "1", either of the "rise pattern" or the "fall pattern" is designated dependent upon whether a note of minor seventh degree is included or not. Accordingly, the information $R_2$ and the minor seventh degree detection signal $7^b$ are applied to the AND circuit $AN_{21}$ and the signal R becomes logical value "1" when the output of the AND circuit $AN_{21}$ becomes logical value "1", designating the "fall pattern".

Referring to FIGS. 6 and 7, the notes C, C# . . . E are not sounded in the first octave range but only in the second octave range ($C_2$–$E_2$). Accordingly, the output lines of the decoder 26 corresponding to the notes C, C# . . . E are connected to an OR circuit $OR_{13}$ and the output of the $OR_{13}$ is applied to an OR circuit $OR_2$. In the "fall pattern", the notes C, C# . . . A with first degree are sounded in the second octave range. Accordingly, the output lines of the decoder 26 corresponding to the notes F, F# . . . A are connected to an OR circuit $OR_{16}$ and the output of the OR circuit $OR_{16}$ is applied to an AND circuit $AN_{22}$. The AND circuit $AN_{22}$ also receives the root selection pulse $P_1$ and the degree change designation signal R representing the "fall pattern". Since the notes $C_2$–$G_2$ of minor seventh degree are sounded in the second octave range, the output lines of the decoder 26 corresponding to the notes F, F♯ and G are connected to an OR circuit $OR_{14}$ and the output of the OR circuit $OR_{14}$ is applied to an AND circuit $AN_{26}$. The AND circuit $AN_{26}$ also receives the minor seventh degree selection pulse $P_7{}^b$.

The notes $C_2$–$G_2$ of minor third degree are sounded in the second octave range and, accordingly, the output of the OR circuit $OR_{14}$ (i.e. the outputs F, F♯, G of the decoder 26) are applied to an AND circuit $AN_{24}$. The AND circuit $AN_{24}$ also receives the minor third degree selection pulse $P_3$. Since the $C_2$–$G_2$♯ of major third degree are sounded in the second octave range, the output lines of the decoder 26 corresponding to the notes F–G♯ are connected to an OR circuit $OR_{15}$ and the output of the OR circuit $OR_{15}$ is applied to an AND circuit $AN_{25}$. The AND circuit $AN_{25}$ also receives the major third degree selection pulse $P_3$. In the case of the "rise pattern", all notes of perfect fifth degree are sounded in the second octave range. Accordingly, the perfect fifth degree selection pulse $P_5$ and the degree change designation signal R inverted by an inverter IN are applied to an AND circuit $AN_{23}$ so that all the notes are sounded in the second octave range when the selection pulse $P_5$ is produced in the rise pattern (i.e. when the signal R is "0").

If the outputs of the AND circuits $AN_{22}$–$AN_{26}$ are logical value "1", the second octave range is designated. Accordingly, the outputs of the AND circuit $AN_{22}$–$AN_{24}$ are applied to a hold circuit 81 through an OR circuit $OR_{12}$. The hold circuit 81 receives a self hold signal H from the NOR circuit 250 (FIG. 1) and the octave range designation signal is self-held in synchronization with self-holding in the hold circuit 25 (FIG. 1). The octave range designation signal oct thus held in the hold circuit 81 is thereafter supplied to the tone generator 27 in synchronization with the note signal output from the decoder 26.

In utilizing the root and subordinate note selection pulses $P_1$–$P_{7b}$, occurence of these selection pulses must be synchronized with the note signal output from the decoder 26. For this purpose, the selection pulses $P_1$–$P_{7b}$ sequentially supplied from the selection control unit 23 are self-held in a hold circuit 82. The respective pulses are applied to a NOR circuit 83 to form self-holding control signals and the self-holding in the hold circuit 82 is controlled by these control signals. The hold circuit 82 has a construction similar to that of the hold circuit 25 (FIG. 1). The hold circuit 82 is necessary only in the case where the rhythm pulses $T_1$–$T_3$ are used without any modification in the selection control unit 23 (FIG. 1). In the case where the selection pulses $P_1$–$P_{7b}$ are formed from the hold rhythm pulses $HT_1$–$HT_3$ which are obtained by holding the rhythm pulses $T_1$–$T_3$, the hold circuit 82 is not required. It will be noted from the foregoing description that the root and subordinate note selection pulses $P_1$–$P_{7b}$ are utilized in synchronization with and in correspondence to the note signals provided by the decoder 26.

With reference to Tables III and V and FIGS. 1, 5 and 6, an example of the bass accompaniment pattern will be described. First, the performer selects a desired rhythm by suitable means such as a selection switch (not shown). If, for example, the rhythm of ♭rumba" is selected, the degree change information $R_1$, $R_2$ become "0, 1" and the rhythm pulses $T_1$–$T_3$ are generated from the rhythm pulse generator 24 (FIG. 1) at timing corresponding to rumba. The information $R_1$, $R_2$ is obtained by suitably encoding the signals supplied from the selection switch or the like. Further, let us assume that contents of bass variation designation signals $V_1$, $V_2$ are "1, 1".

If, for example, the chord name C minor is designated upon depression of the key, the root and subordinate note selection pulses are generated in the order of $P_1$, $P_{3b}$ and $P_5$ and the note signals are produced in the order of the notes C, D♯ and G. When the signal of the note C is produced from the decoder 26, the octave range designation signal oct which is produced through the OR circuits $OR_{13}$, $OR_{12}$ becomes logical value "1" designating a note in the second octave (i.e. note $D_2$♯). When the signal of the note G is produced, the perfect fifth degree selection pulse $P_5$ is generated and the degree change designation signal R is logical value "0". The AND circuit $AN_3$ therefore is enabled and the signal oct designates a note in the second octave range (i.e. note $G_2$).

If the chord name F minor is designated, the note signals are produced from the decoder 26 in the order of the notes F, G♯ and C. When the signal of the note F is produced, the root selection pulse $P_1$ is generated. Since, however, the signal R is logical value "0", the AND circuit $AN_{22}$ is not enabled. Accordingly, the signal oct is logical value "0", designating a note in the first octave range (i.e. note $F_1$). Although the minor third degree selection pulse $P_{3b}$ is generated when the signal of the note G♯ is produced, the AND circuit $AN_{24}$ is not enabled because the signal of the note G♯ is not applied to it. Accordingly, the signal oct is logical value "0", designating a note in the first octave range (i.e. note $G_1$♯). If the signal of the note C is produced, a note in the second octave range is designated for the same reason as was previously described. It will be noted from the foregoing description that the rise and fall patterns of the degree change remain unchanged if the kind of rhythm (e.g. rumba) and the kind of chord (e.g. minor chord) remain unchanged even through the chord name differs. The present embodiment is capable of accurately simulating not only the above described patterns but all the predetermined base accompaniment patterns as shown in FIG. 6.

Figure 8:
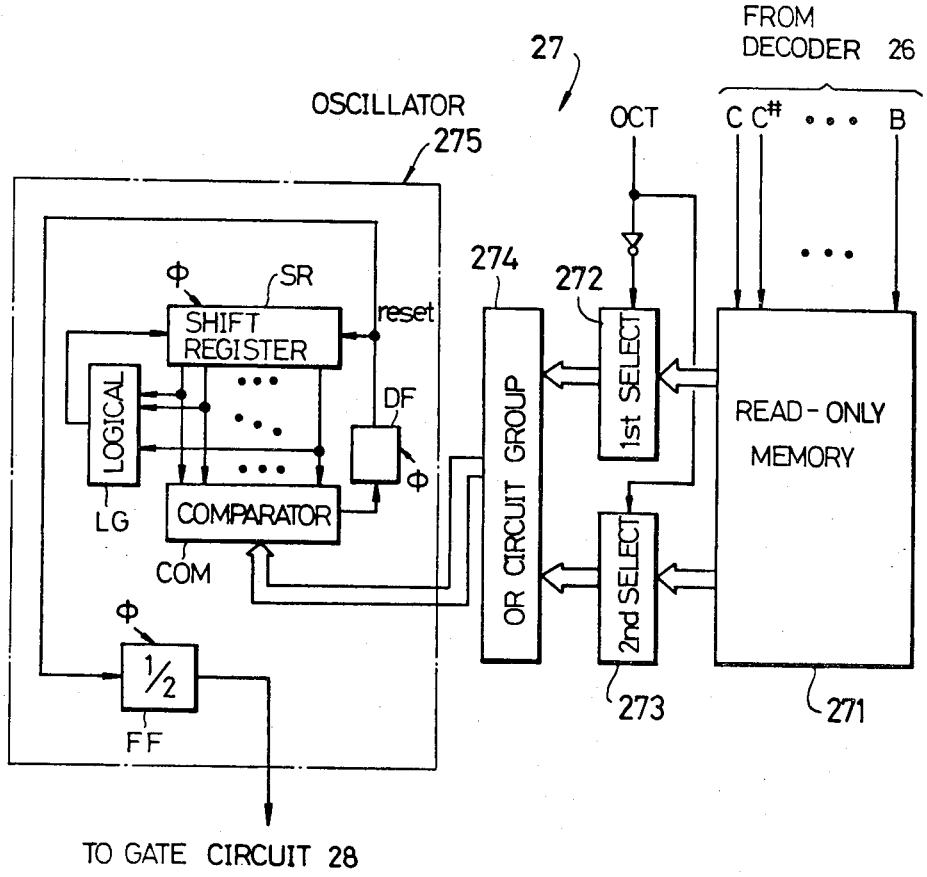
FIG. 8 is a block diagram showing a tone generator of FIG. 5 in detail.

The tone generator 27 is provided for producing a bass tone corresponding to the note of the signal supplied from the decoder 26 at a frequency within the octave range designated by the octave range designation signal oct. The tone generator 27 can produce signals with frequencies corresponding to the notes in the first and second octave ranges. An example of the tone generator 27 is shown in FIG. 8. The note signals from the decoder 26 are supplied to a read-only memory 271 which stores digital information of plural bits corresponding to frequencies of the notes in the first and second octave ranges. Digital information corresponding to a particular note designated by the note signal fed from the decoder 26 is read from the read-only memory 271 and is delivered out through either a first select circuit 272 or a second select circuit 273. This digital information is applied to an oscillator 275 through an OR circuit group 274. In the oscillator 275, the digital information is compared in a comparator COM with contents of each stage of a shift register SR. All the contents of the shift register SR are reset when both data coincide with each other and a frequency signal corresponding to the timing of resetting is generated. If, for example, the digital information is data of 10 bits, the register SR has 10 bit stages, logical value contents of the respective stages thereof being input to the register SR through a logical circuit LG. This input signal is sequentially shifted to a next stage in accordance with clock $\phi$. When coincidence is detected by the comparator COM, the reset signal is produced from the register SR through a one-bit buffer register DF. This reset signal is applied to a two divider FF where it is divided in frequency to half and the output of this two divider FF constitutes the output frequency signal of the tone generator 27. Resetting period of the shift register SR is determined in accordance with the value of the digital information read from the read-only memory 271. In determining this value of digital information, frequency to be oscillated, construction of the logical circuit LG and rate of the clock $\phi$ are considered. The digital information corresponding to the respective frequencies determined in the foregoing manner is previously stored in the read-only memory 271.

The example of the tone generator 27 shown in FIG. 8 is constructed of a kind of variable frequency divider. The tone generator 27 may also be constructed of a different type of variable frequency divider or it may comprise a plurality of oscillators for generating frequencies of the notes in the first and second octave ranges and a plurality of frequency dividers, a necessary frequency being selected in response to the note signal from the decoder 26 and the octave range designation signal oct.

What is claimed is:

1. An automatic accompaniment apparatus comprising:

a circuit for producing signals representing the root and subordinate notes of a chord;

a circuit for designating a predetermined bass degree change pattern;

a circuit for detecting, in accordance with the designated degree change pattern, which one of a plurality of octave ranges the root and subordinate notes belong to; and a circuit for producing a bass tone corresponding to frequencies of the root and subordinate notes in the detected octave range.

2. An automatic accompaniment apparatus comprising:

keys;

a keyboard circuit coupled to said keys for delivering out, upon depression of a key among said keys, a signal indicating the name of a note corresponding to the depressed key;

a self-holding circuit for receiving and holding the signal from said keyboard circuit, said signal being released to the output of said self-holding circuit when a different key is depressed;

a chord name detection circuit for detecting the name of a chord in response to the output of said self-holding circuit; and a tone producing circuit receiving the output of said chord name detection circuit and producing, in response thereto, tone signals of notes constituting said chord.

3. In an electronic musical instrument having keys, an automatic accompaniment apparatus comprising:

a circuit coupled to said keys for detecting, upon depression of a single key among said keys, the name of the note of said depressed key and delivering a first signal indicating said note name for the root of a chord to be audibly reproduced;

an encoder circuit receiving said first signal and producing second signals in the form of binary digital words respectively representing names of notes for respective degree constituents of said chord;

a selection circuit receiving said second signals and selectively delivering out a third signal constituted by a chronological alignment of at least one of said second signals;

a decoder circuit receiving said third signal and producing fourth signals of sequentially aligned individual outputs respectively indicating notes to be audibly reproduced;

a tone producing circuit receiving said fourth signals and producing, in response thereto, tone signals of the notes indicated by said fourth signals;

a further decoder circuit receiving one of said second signals and producing a decoded output indicating the name of a root note of a chord to be audibly reproduced; and a further tone producing circuit receiving said decoded output and producing, in response thereto, tone signals of notes constituting said chord.

4. In an electronic musical instrument having keys, an automatic accompaniment apparatus comprising:

a circuit coupled to said keys for detecting, upon depression of a single key among said keys, the name of the note of said depressed key and delivering a first signal indicating said note name for the root of a chord to be audibly reproduced;

an encoder circuit receiving said first signal and producing second signals in the form of binary digital words respectively representing names of notes for respective degree constituents of said chord;

a selection circuit receiving said second signals and selectively delivering out a third signal constituted by a chronological alignment of at least one of said second signals;

a decoder circuit receiving said third signal and producing fourth signals of sequentially aligned individual outputs respectively indicating notes to be audibly reproduced;

a tone producing circuit receiving said fourth signals and producing, in response thereto, tone signals of the notes indicated by said fourth signals; and a rhythm pulse circuit for producing rhythm pulses for said respective degree constituents, each pulse being of a rhythm pattern for the associated constituent and being applied to said selection circuit for selecting out said second signals according to said rhythm pattern.

5. In an electronic musical instrument having keys, an automatic accompaniment apparatus comprising:

a chord name detection circuit coupled to said keys for detecting the name of a chord constituted by notes of depressed keys and delivering a first signal indicating the chord name;

an encoder circuit receiving said first signal and producing second signals in the form of binary digital words respectively representing names of notes for respective degree constituents of said chord;

a selection circuit receiving said second signals and selectively delivering out a third signal constituted by a chronological alignment of at least one of said second signals;

a decoder circuit receiving said third signal and producing fourth signals of sequentially aligned individual outputs respectively indicating notes to be audibly reproduced;

a tone producing circuit receiving said fourth signals and producing, in response thereto, tone signals of the notes indicated by said fourth signals;

a further decoder circuit receiving one of said second signals and producing a decoded output indicating the name of a root note of a chord to be audibly reproduced; and a further tone producing circuit receiving said decoded output and producing, in response thereto, tone signals of notes constituting said chord.

6. In an electronic musical instrument having keys, an automatic accompaniment apparatus comprising:

a chord name detection circuit coupled to said keys for detecting the name of a chord constituted by notes of depressed keys and delivering a first signal indicating the chord name;

an encoder circuit receiving said first signal and producing second signals in the form of binary digital words respectively representing names of notes for respective degree constituents of said chord;

a selection circuit receiving said second signals and selectively delivering out a third signal constituted by a chronological alignment of at least one of said second signals;

a decoder circuit receiving said third signal and producing fourth signals of sequentially aligned individual outputs respectively indicating notes to be audibly reproduced;

a tone producing circuit receiving said fourth signals and producing, in response thereto, tone signals of the notes indicated by said fourth signals; and a rhythm pulse circuit for producing rhythm pulses for said respective degree constituents, each pulse being of a rhythm pattern for the associated constituent and being applied to said selection circuit for selecting out said second signals according to said rhythm pattern.

7. An automatic accompaniment apparatus as claimed in claim 6 which further comprises:

a seventh circuit for variably setting the rhythm patterns of said rhythm pulses.

8. An automatic accompaniment apparatus as claimed in claim 6, which further comprises:

a note selection circuit for selecting a single note from among notes of depressed keys when the chord to be played is a special chord which cannot be detected by said chord name detection circuit; and means for applying the selected note to said performance circuit as the fundamental note of said special chord.

* * * * *